US005092482A

United States Patent [19]

Wight et al.

[11] Patent Number: 5,092,482

[45] Date of Patent: Mar. 3, 1992

[54] SLUDGE DIGESTERS WITH SEPARATE LIQUID CHAMBERS TO BUOY BALLAST MEMBERS

[75] Inventors: Jeffrey L. Wight, Salt Lake City; Lynn W. Cook, Fruit Heights, both of Utah

[73] Assignee: Envirotech Corporation, Salt Lake City, Utah

[21] Appl. No.: 492,776

[22] Filed: Mar. 12, 1990

[51] Int. Cl.[5] ..... COF2 11/04

[52] U.S. Cl. ..... 220/217; 210/608; 210/DIG. 9

[58] Field of Search ..... 220/216, 217, 222, 225, 220/226, 227; 210/DIG. 9, 608

[56] References Cited

U.S. PATENT DOCUMENTS

| | | | |
|---|---|---|---|
| 1,714,209 | 5/1929 | Bohnhardt | 220/217 |
| 1,735,461 | 11/1929 | Haupt | 220/224 |
| 1,906,685 | 5/1933 | Wiggins | 220/217 |
| 1,919,634 | 7/1933 | Haupt et al. | 220/227 |
| 1,930,953 | 10/1933 | Hampton | 220/224 |
| 1,989,589 | 1/1935 | Fischer et al. | 210/DIG. 9 X |
| 2,061,175 | 11/1936 | Staber | 220/225 X |
| 2,132,837 | 10/1938 | Talbot | 210/DIG. 9 X |
| 2,541,090 | 2/1951 | Orr et al. | 220/217 X |
| 2,679,477 | 5/1954 | Kivari et al. | 210/608 |
| 3,288,295 | 11/1966 | Kelly | 210/DIG. 9 X |
| 4,166,835 | 9/1979 | Anderson | 210/DIG. 9 X |
| 4,173,291 | 11/1979 | Hills | 220/225 |
| 4,391,705 | 7/1983 | Cook et al. | 210/DIG. 9 X |

*Primary Examiner*—Steven M. Pollard
*Attorney, Agent, or Firm*—Trask, Britt & Rossa

[57] ABSTRACT

A sludge digester gas-holder is disclosed having a gas-holding cover with ballast members submergible in a liquid medium contained within a chamber circumscribing the upper portion of the tank wall and separate from the main tank cavity.

11 Claims, 5 Drawing Sheets

SLUDGE DIGESTERS WITH SEPARATE LIQUID CHAMBERS TO BUOY BALLAST MEMBERS

BACKGROUND OF THE INVENTION

1. Field

The invention relates to sludge digesters of the gas holding type having a telescoping cover which floats on an envelope of gas generated by decomposing sludge. The cover typically has a top (roof) and a cylindrical side wall. Such digester covers further have ballast members which are generally formed of concrete. These depend into the sludge which has some buoyant effect upon the ballast members to create a differential gas pressure between the submerged and emerged conditions of said ballast members.

2. Technology Background

Ballasted, gas-holding, sludge digesters for digesting municipal waste are well known in the art. U.S. Pat. No. 4,391,705 to Cook, et al. discloses a uniquely ballasted sludge digester of a gas holding type. The ballast members of Cook et al. contain cavities so that sludge fills the cavity to increase the ballast weight as the ballast members emerge from the sludge surface. The Cook et al. sludge digester has been identified by its manufacturer as a "Hydroballast Digester" TM.

Prior to the development of the sludge digesters of the type disclosed in the Cook, et al. patent, it was common to use gas holding covers having solid concrete blocks attached to the lower end of the sideskirt to add extra weight to the cover to increase the pressure of gas contained within the digester. When the concrete block ballasts were submerged in the sludge a buoyant force was exerted by the sludge upon the ballast members according to Archimedes principal. Concrete used in ballast members generally has a density of about 150 pounds per cubic foot. A cubic foot of concrete in a submerged condition in sludge having a specific gravity of about 1.0 has an effective weight which is reduced by the weight of a cubic foot of sludge (about 62.4 pounds per cubic foot). Thus, in a submerged condition one cubic foot of a solid concrete ballast exerts a downward force of about 87.6 pounds.

When the ballast members of a gas holding digester cover emerge from the sludge then the effective weight of the concrete is its normal density, i.e. about 150 lbs/ft$^3$. Thus, the total weight of the cover is significantly greater when the ballast members are in an emerged condition than when the ballast members are in a submerged condition. This creates a gas pressure differential between the submerged and emerged positions of the ballast. Typically, the operating pressure of the digester is that of the ballast when it is raised from the corbels, but still in a submerged condition. When the ballast members are fully emerged from the sludge the pressure generated is usually at or above the relief valve settings so that typically the ballast members are never fully emerged from the sludge without the relief valves on the cover relieving the pressure of the gas.

Gas storage tanks which employ telescoping covers are known in the petroleum industry wherein volatile liquids such as gasoline are frequently stored in tanks which have a floating cover. In this instance, the cover floats on an envelope of vapors generated by evaporation of gasoline and other volatile liquids. To eliminate evaporation losses which may occur in the "gaps" which exist between the cover and the tank in which the cover telescopes, various types of roof seals have been developed. Exemplary of these roof seals are the seals disclosed in patents to Haupt et al., U.S. Pat. No. 1,919,636, Hills U.S. Pat. No. 4,173,291 and Staber U.S. Pat. No. 2,061,175.

The type of roofs disclosed in Haupt et al. and Hills are ones in which the roof floats directly upon the liquid. The cover disclosed in Staber, however, floats upon an envelope of vapor caused by evaporation of the volatile liquids contained in the tank. The device of Staber is described as a gasometer roof tank and uses a circumferential well located on the exterior of the main tank to hold water to effect a seal between the gases which are typically at a pressure of three inches water column (col. 4, line 22) on the interior and the atmosphere. The device of Staber also provides for the collection of volatile condensate in the well.

Seal troughs have been used because of the volatility of liquids within a tank, e.g. gasoline. The sole purpose of a seal trough, either with a fixed or floating cover, is to provide a system for preventing a vapor or gas from escaping from under the cover to the atmosphere. The depth of such a trough with a floating cover is equivalent to the length of travel of the cover plus a liquid column height equal to the cover pressure which, as indicated in Staber, is often in the range of a few inches water column. The width of a seal trough may be minimal.

In sludge digesters water seals have been used with some fixed covers. Generally, with sludge digester gas holder covers which float on an envelope of gas the sideskirt and ballast have been immersed in the sludge liquid which acts as a seal. Various types of seals have been used with sludge digester floating covers, such as those disclosed in U.S. Pat. Nos. 1,735,461 (Haupt), 1,930,953 (Hampton), 1,919,634 (Haupt et al.) and 4,173,291 (Hills).

Gas-holder telescoping covers of the type disclosed in Kelley, U.S. Pat. No. 3,288,295 and Fisher et al., U.S. Pat. No. 1,989,589 were generally heavier than the more structurally sophisticated covers presently being designed and utilized. Concurrently with the design of lighter covers has been the requirement for increased operating gas pressure. Gas pressures of from six inches of water, and frequently from eight inches or more, up to fifteen inches are relatively common with modern sludge digesters. While the covers of Fisher utilized concrete ballast, the amount or concrete ballast used in a modern gas holding cover is much greater. The need for greater ballasting led to the development of the unique ballast disclosed in Cook et al. Increased ballast weight has resulted in very large concrete ballast members. The use of such large ballast members, including those of the Cook et al. type, within a large sludge tank has generally been readily feasible although concerns over grit accumulation in the Cook et al. type ballast have existed and increased structural support for such large ballasts has been required. Corrosion of ballast support members can be a problem. Corrosive failure of ballast support members can, and has, resulted in some instances of digester operation in the ballast members being dumped in the sludge, causing the cover to tilt and bind.

Gas-holding, sludge digesters have been ballasted in the manner illustrated in Fisher et al. In practice, the sideskirts of such covers are usually constructed quite long so to maintain the ballast in a submerged condition in the fluctuating level of sludge within the digester.

The cover of Fisher et al. was ballasted with a concrete ballast member in the form of a continuous ring having a sloped top. The sloped top on the ballast ring was to prevent accumulation or grit and silt on the top surface of the ballast. The ballast member and its supports are generally submerged or partially submerged in the sludge. The sludge contains organic and inorganic liquids and solids and is corrosive and toxic. The immersion of the sideskirt in the sludge exposes the sideskirt, ballast supports, roller guides and the like to gritty, corrosive conditions.

Water troughs external to a fixed cover have been used as seals. Such troughs are situated adjacent the upper edge of the main tank digester usually on the outside of the main tank wall. The cover is fixed to the upper edge of the main tank wall and has a very short skirt which extends downward into the trough. The purpose of the skirt is to cause the gas envelope to be in contact with the water seal. The trough is filled with water to create a water seal to prevent gas on the inside of the cover from escaping to the atmosphere. Such troughs are usually no deeper than about three feet and are about one foot in width.

Launders, which are liquid overflow troughs, are illustrated in U.S. Pat. No. 2,679,477 to Kivari et al. Such troughs are located at the upper lip of tank on the outside surface of the tank wall. These are relatively small in comparison to the tank.

Neither launders, fixed roof seal troughs or seal troughs for telescoping covers are sufficiently large to accommodate the large dimensioned ballast members used in the higher pressure gas-holding sludge digesters presently being constructed.

SUMMARY OF THE INVENTION

The instant invention comprises a sludge digester having a main tank in conjunction with a gas holding cover having a roof and depending sideskirt which telescopes in relationship to the main tank. At the bottom edge of the sideskirt, which typically has a cylindrical shape, are located a multitude of ballast members, usually constructed of concrete, having a density significantly greater than water. The main tank has a separate annular chamber, either internal or external to the main side wall of the tank, to hold the liquid in which the sideskirt and ballast members are submerged. The sideskirts are equipped with rollers or other guide means which function to stabilize the cover during its telescoping travel within the tank.

Sludge digesters generally operate in a dynamic condition. Typically, fresh sludge is continuously entering the digester while sludge which is decomposed exits the digester, either continuously or periodically. Gas is continually evolving within the digester due to the decomposition of organic matter within the sludge. The rate at which gas evolves is generally dependent upon the amount and type of organic matter in the sludge, the temperature of the sludge, the concentration and type of bacteria in the sludge as well as other minor factors such as pH, heavy metal hydroxide concentration and sludge conditions. The inflow and outflow rate of sludge and decomposition rate of the sludge may not always be the same. Thus, the level of sludge within the digester may rise and fall. Assuming a constant gas pressure within the tank, rising and falling of the sludge level will affect the position of the cover, causing it to rise and fall with the sludge level. The cover also rises and falls as the pressure or volume of gas changes, for example, as gas is withdrawn or as gas generation rate changes.

DETAILED DESCRIPTION OF INVENTION

The instant invention relates to sludge digesters which have a floating cover which floats on an envelope of gas. These sludge digesters are generally referred to as gas holding sludge digesters. Such sludge digesters are composed of a main tank, generally of a cylindrical form and generally formed of concrete, and a steel cover formed of a dishshaped top (roof) and cylindrical side wall which telescopes in relation to the main digester tank. The cover is generally ballasted with ballast members suspended from the cylindrical side wall (sideskirt) near its lower edge.

Further description of the invention may be facilitated by reference to the attached drawings.

Figure 1:
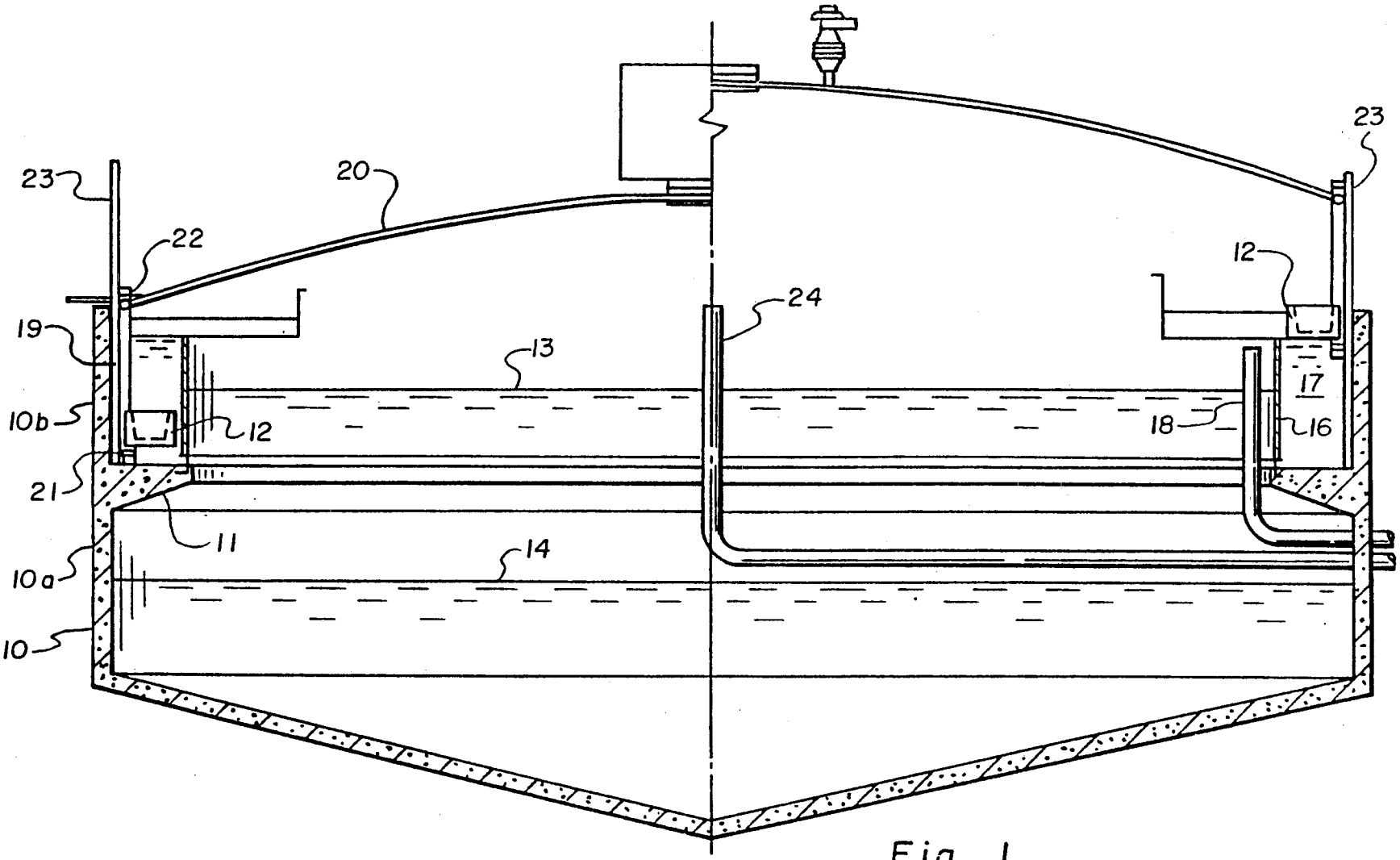
FIG. 1 is an elevational, cross-sectional view of a sludge digester having a separate buoyancy chamber to contain a ballasted sideskirt.

A sectional, elevational view of the digester of the instant invention is illustrated in FIG. 1. The digester has a tank wall 10 which is generally a large, cylindrical, concrete structure frequently from 20, although typically from 50 to 125 feet or more in diameter. A corbel 11 is an integral part of the tank wall 10. In the instant invention, the corbel is an extended corbel significantly wider than the ballast member 12 and is an annular ring, circumscribing the entire interior of the main tank wall 10. The tank wall 10 of the instant invention generally comprises two portions, a lower portion **10*a* which is below the corbel 11 and an upper portion 10*b* which is above the level of the corbel. The portion of the tank wall 10*a* below the corbel generally is filled with sludge although as indicated by lines 13 and 14 the level of sludge in the tank may vary considerably during operation with the sludge level normally being at a height well above the corbels. An overflow pipe 15 is installed such that the top of the overflow is slightly lower than the interior sidewall 16 of the liquid ballast bath 17 so that sludge does not overflow into the liquid ballast bath 17**.

The wall member 16 in FIG. 1 is a steel cylindrical wall which is embedded within the free end of corbel 11 and completely circumscribes the interior of the digester and is concentric with the tank wall 10 and spaced from tank wall portion 10*b* to form a ballast bath 17. The spacing between interior wall 16 and tank wall portion 10*b* is greater than the width of the ballast member, for example, guide members, and any structure associated with the ballast member as well as the thickness of the sideskirt. The sideskirt 19 is a cylindrical steel member depending from the domed cover 20.

The cover illustrated in FIG. 1 has rollers 21 and 22 which interact with the extended upright roller guide 23 to guide the cover as it telescopes upwardly and downwardly in the main tank. Relief valve settings are set so that typically the ballast members are never fully emerged from the sludge without the relief valves relieving the pressure of the gas.

Sludge liquid within the digester has generally been the liquid in which the ballast members are submerged. The sludge liquid generally has a specific gravity which is within a few percent of the same specific gravity as water.

In the instant invention, as illustrated in FIG. 1, the ballast members are submerged in water or other liquid which is separated from the sludge by an interior wall 16. The ballast members rise and fall in the ballast bath. The ballast bath will generally be water although other liquids could be utilized.

The ballast members illustrated in FIG. 1 have a cavity in which to contain liquid from the ballast bath. Other types of concrete ballast members such as a solid concrete block either of normal density concrete having the density of about 150 pounds per cubic foot or light weight concrete having a density substantially less than 150 pounds per cubic foot may be used in the invention. The ballast members are attached to and supported by the sideskirt.

The gas is extracted from the tank by gas withdrawal pipe 24. It is also feasible to have a gas withdrawal pipe which projects through the roof or lid of the cover.

In FIG. 1 the cover is illustrated in a raised position on the right hand side of the drawing, while on the left hand side of the drawing the cover is shown in a low or rest position.

Figure 2:
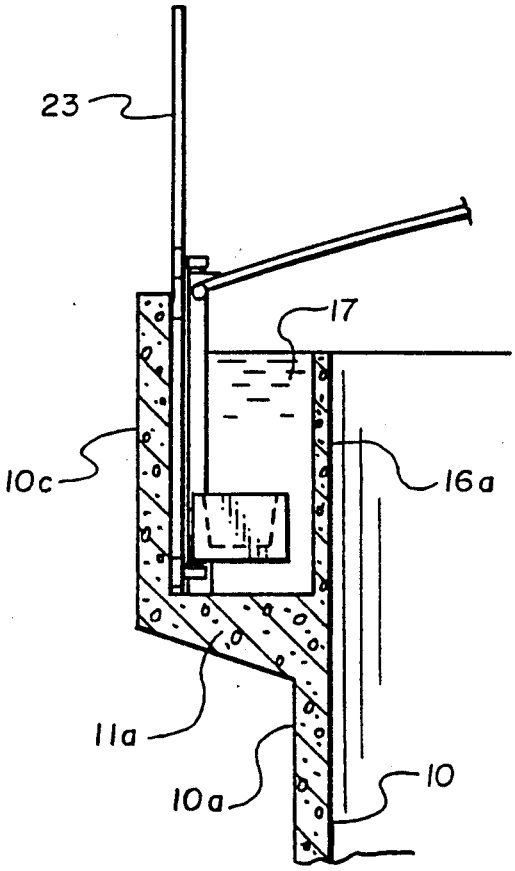
FIG. 2 is an elevational, cross-sectional view of a buoyancy chamber external to a digester tank.

In FIG. 2, which is a partial sectional elevational view of a digester cover and tank of the instant invention, a slightly different arrangement of the tank sidewall is illustrated. In FIG. 2 the main tank wall 10 is illustrated with the lower portion 10*a* below the corbel, wherein the corbel 11*a* extends outboard of the main tank, rather than inboard as illustrated in FIG. 1. Also in FIG. 2 the inner wall of the ballast bath 16*a* is constructed of concrete rather than a steel sidewall as illustrated in FIG. 1 and illustrated in FIG. 3. The upper wall 10*c* of the main tank is offset from the lower portion 10*a* by the width of the corbel. In the instant invention the concrete extension member 11*a* which forms the base of the ballast bath 17 is referred to as a corbel even though it is a continuous member extending around the inside of the tank, rather than being a number of discrete, separate members as has been traditional in the industry.

Figure 3:
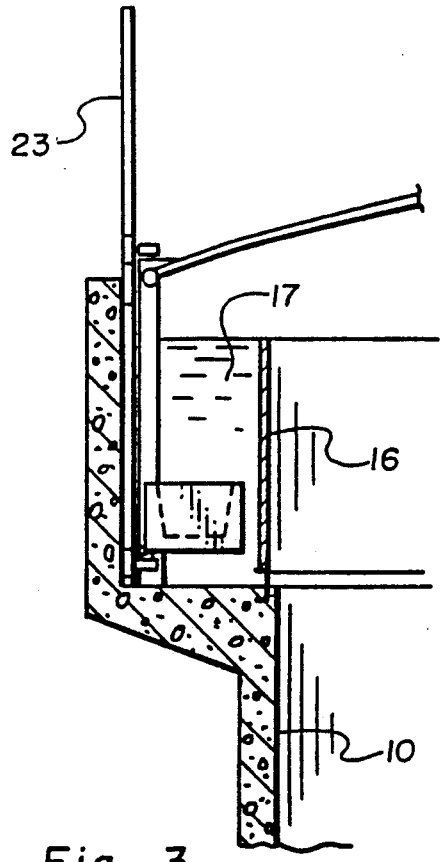
FIG. 3 is an elevational, cross-sectional view of a buoyancy chamber with an interior metal wall.

The elevational, sectional view illustrated in FIG. 3 is similar to that of FIG. 2 except that the interior wall is a steel wall as illustrated in FIG. 1. The construction of the main tank wall in FIG. 3 is the same as that in FIG. 2 and the advantages of such structure are several:

(1) The corbel member may be supported by earth on the exterior of the tank and have the earth serve as a bearing load surface for the corbel member.

(2) The ballast bath 17 is outboard of the main tank member 10 such that the gas-holding portion of the tank is expanded. Further discussion of this will occur in reference to later identified figures.

Figure 4:
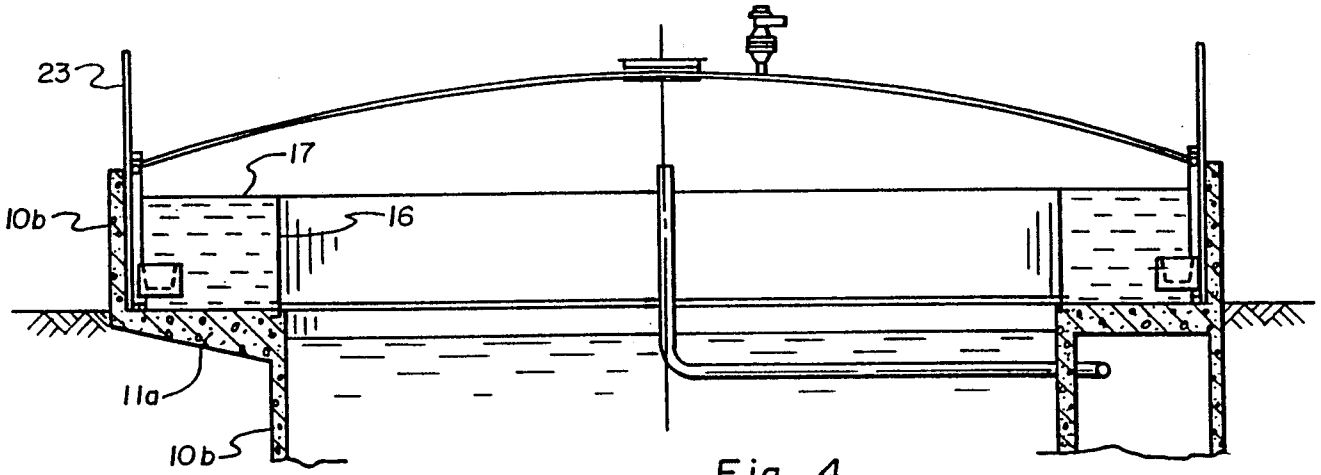
FIG. 4 is an elevational, cross-sectional view of a digester having a separate buoyancy chamber and an enlarged gasenclosing cover.

FIG. 4 illustrates a corbel member 11*a* which is similar to the corbel in FIG. 2, except that it is more horizontally extended, i.e. forms a wide base in the ballast bath. In the digester illustrated in FIG. 4, the main tank may be of a smaller diameter and hold less sludge in comparison to the amount of gas storage capacity. In certain digesters the quantity of gas storage may be a primary consideration. Digester tanks such as that illustrated in FIG. 4 accommodate a large quantity of gas storage for a minimum sludge volume. In the digester of FIG. 4 the interior wall 16 forms one wall of ballast bath 17 wherein wall 16 is placed a considerable distance from wall 10*b* to allow extra working space between the ballast and wall member 16.

Figure 5:
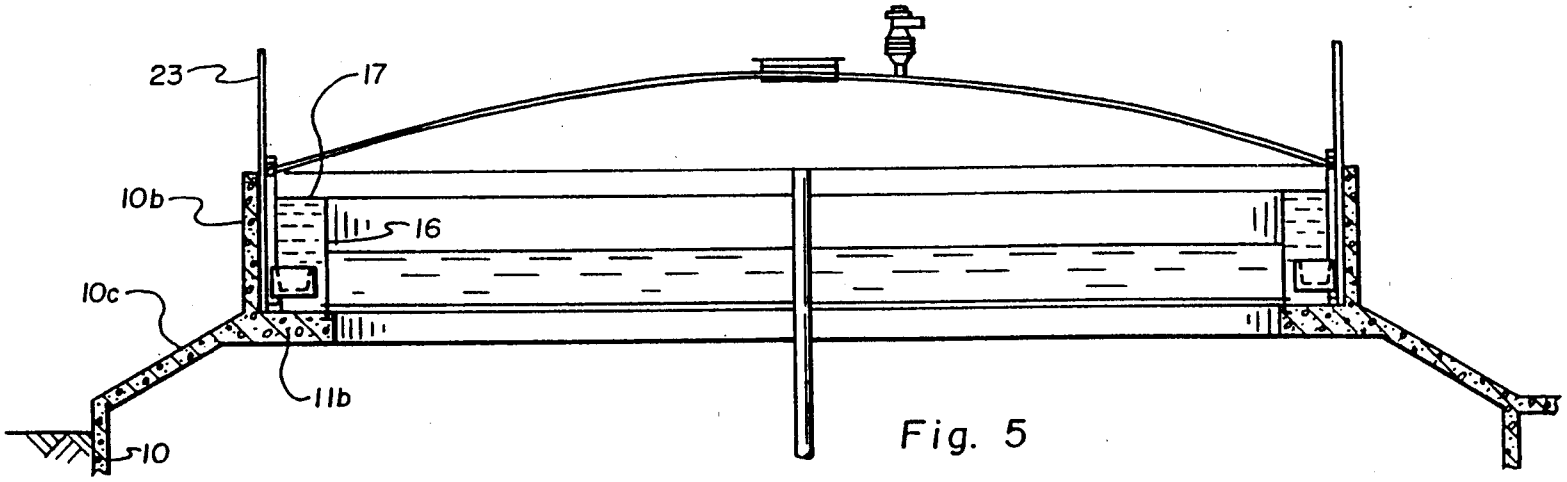
FIG. 5 is an elevational, cross-sectional view of a sludge digester with a separate buoyancy chamber and an enlarged digester tank.

Another digester tank is illustrated in FIG. 5 wherein the tank wall 10*a* has a much greater diameter than the upper tank wall 10*b*. Tank walls 10*a* and 10*b* are joined by sloping tank wall 10*c*. Corbel member 11*b* which is a continuous ring around the interior of the tank is positioned at the juncture of the upper tank wall 10*b* and sloped into tank wall 10*c*. Inner wall 16 is attached to corbel member 11*b* and along with tank wall 10*b* and corbel member 11*b* form the ballast bath 17. The structure of the digester tank in FIG. 5 is one in which the sludge volume is designed to be maximized with reference to the gas storage volume.

Figure 6:
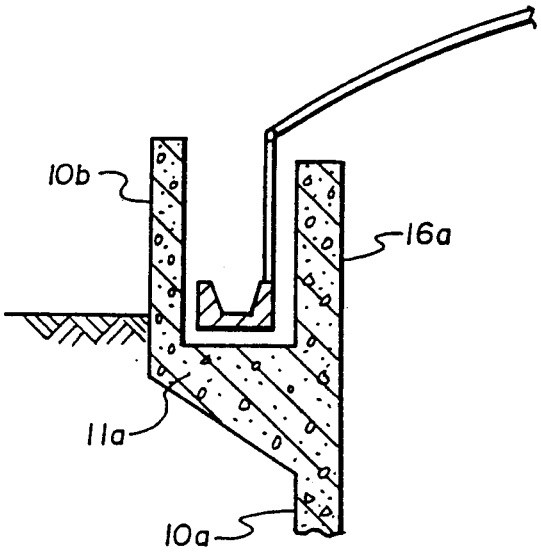
FIG. 6 is an elevational, cross-sectional view of an external buoyancy chamber with an external ballast construction.
Figure 7:
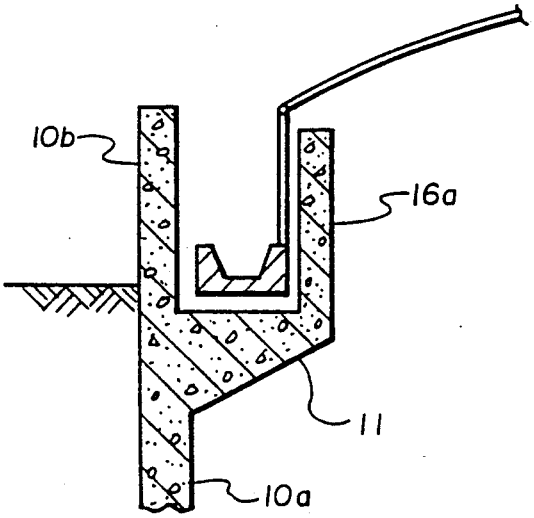
FIG. 7 is an elevational, cross-sectional view of an internal buoyancy chamber with an external ballast construction.

FIGS. 6 and 7 are elevational, sectional views of another embodiment of the instant invention wherein the buoyant liquid chamber is external to the main tank and structured in a manner that the ballasts can be attached to the outboard surface of the sideskirt. FIG. 6 illustrates an embodiment wherein the corbel member is directed outboard of the main tank wall 10*a* and has the advantage of being partially supportable by earth fill. In the embodiment of FIG. 6 the upper tank wall 10*b* and inner wall 16*a* are both formed with concrete and the structure is an integral concrete structure of the upper wall 10*b*, the interior wall 16*a*, the corbel member 11*a* and the main tank wall 10*a*. The structure illustrated in FIG. 7 is similar except that the corbel member is directed to the interior of the tank and is supported only by tank wall 10*a*.

Numerous advantages exist for having the ballast bath external to the main tank, that is, with the ballast members on the outside of the sideskirt. For example, the density in the external liquid ballast bath 17*a* may be changed by adding heavy, soluble inorganic salts which will change the buoyancy of the liquid with reference to the concrete and will change the weight of the liquid in the ballast cavity. Different operating pressures for the gas holder cover may be obtained by changing the buoyant liquid density. Also, the construction of the tank may be facilitated by an external chamber inasmuch as the cover may be completely constructed in-place before the ballast members are attached. Also, it is easier to attach the ballast members inasmuch as they are positioned externally of the main cover.

In construction of a cover such as that illustrated in FIG. 1 the metal plates which form the top cover 20 of the gas holding cover cannot be all in place before the ballast members are lifted into place by a crane. However, in a structure such as that illustrated in FIG. 6, the cover roof may be completely made, welded to the sideskirt, and, in fact, the liquid ballast bath or well may be filled with water and the cover pressure tested before the ballast members are added. Also, the use of the external well permits visual inspection of the water level in the well and even permits easier visual inspection of the ballast so that it would be known whether any ballast which have cavities have developed cracks and are perhaps not maintaining water tight integrity.

Furthermore, ballasts may be easily removed and weight adjusted, e.g., smaller or larger ballasts can be readily substituted without taking digesters out of operation.

Figure 8:
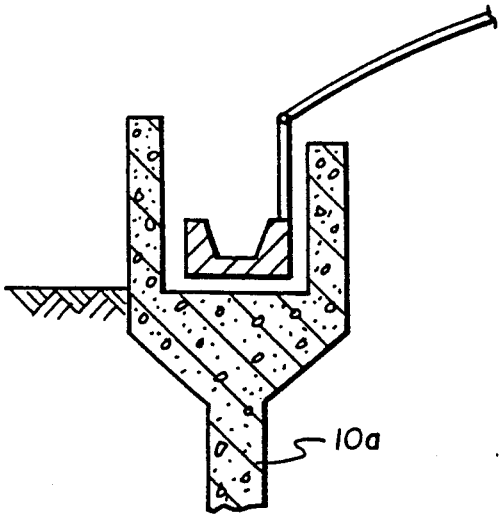
FIG. 8 is an elevational, cross-sectional view of a mid-positioned buoyancy chamber with an external ballast construction.
Figure 9:
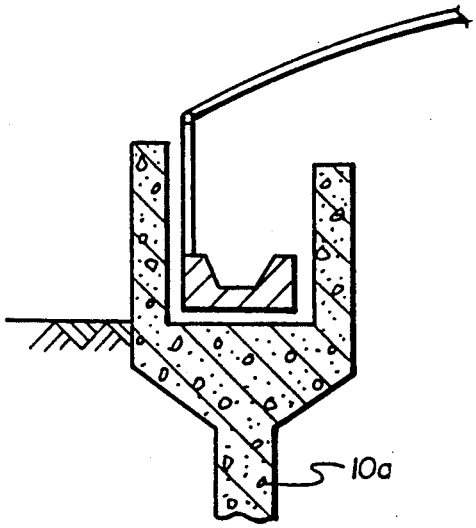
FIG. 9 is an elevational, cross-sectional view of a mid-positioned buoyancy chamber with an internal ballast construction.

The digester tank designs of FIG. 8 and 9 are ones in which the buoyant liquid chamber, whether structured as an inner well or as an outer well, is positioned substantially directly over the main lower tank wall 10*a*. The addition of a buoyant liquid chamber adds considerable additional weight which the lower tank wall 10*a* must support. In a structure such as that illustrated in FIG. 7, the tank wall must support the weight of the roof including the ballast as well as the weight of the buoyant liquid chamber on the corbel member 11 which is cantilevered to the tank wall 10. In the older designs wherein the ballast members were immersed in the sludge there was no buoyant liquid chamber and the corbel members and tank wall had to support only the weight of the ballast and digester cover. For large tanks the weight of the cover including ballast may be as much as 500,000 pounds or more. The weight of water in the buoyant liquid chamber for a digester tank having a 100 foot diameter and five foot wide liquid chamber and having a height of ten feet defines a buoyant liquid volume of about fifteen thousand cubic feet which equates to nearly one million pounds of water. Thus, cantilevering that weight, plus the weight of the cover including ballast as shown in structures illustrated in FIG. 7 may require a very thick concrete tank wall 10, especially at the lower portion and a very thick and strong corbel member 11. The structure illustrated in FIG. 6 may have advantages from a structural standpoint, inasmuch as the corbel member 11*a* extends outboard of the main tank lower portion 10*a* and may be partially supported with earthfill since these tanks are frequently at least partially buried in the earth.

In instances where the tank may not be readily buried or the earth fill does not provide significant support, a tank structure such as that illustrated in FIGS. 8 and 9 may be advantageous wherein the buoyant liquid chamber is positioned with its geometric center substantially over the lower tank wall 10*a*. FIG. 8 illustrates a digester tank with an outer well, while FIG. 9 illustrates a tank with an inner well. The tank wall structure, however, illustrated in FIGS. 8 and 9 is designed to optimize the strength of the structure, rather than to affect the operating characteristics of a digester.

Figure 10:
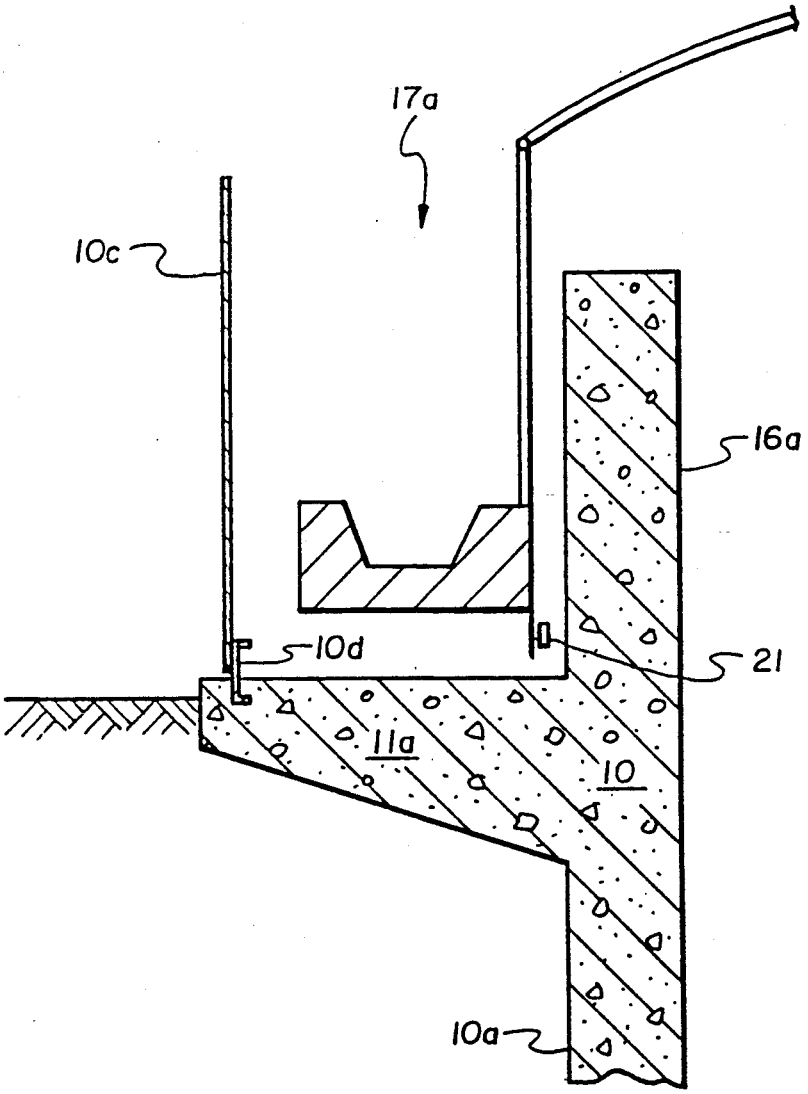
FIG. 10 is an elevational, cross-sectional view of another embodiment of an external buoyancy chamber with an external ballast construction.

The tank wall structure illustrated in FIG. 10 provides a digester with certain advantages both in terms of construction operation and maintenance. Corbel member 11*a* which is a continuous member circumscribing the exterior surface of the main tank wall 10, is integrally formed with the concrete inner wall 16*a* and the lower portion of the main tank wall 10*a*. A steel external wall 10*c* is attached to a flange member 10*d* which is embedded in the corbel member 11*a* near the free end or unsupported end of the corbel member. The structure illustrated in FIG. 10 is shown with the corbel member having earthen fill support to help support the load on the corbel.

A number of advantages accrue from the structure illustrated in FIG. 10. The digester tank wall 10 of concrete is usually formed first in the field, then the cover is assembled and welded in place. In traditional digester tanks where ballast members go on the inside of the tank, the top of the cover must be left partially open so that the digester blocks may be lifted by a crane down onto the support members, or if the ballast is to be poured in place then concrete must be pumped over the wall of the tank into a circular, annual form at the lower end of the interior of the sideskirt. However, with a structure such as that illustrated in FIG. 10 the cover may be completely assembled, including the side wall, and welded together and completely fabricated. The exterior wall 10*c* can be constructed later so that workmen have ready access to the external surface of the sideskirt without having to climb up over the external wall 10*c* and down into the liquid ballast bath 17*a*. Thus, constructing exterior wall 10*c* as a last step has numerous construction advantages. The positioning of the ballast blocks may be done before wall 10*c* is in place so that these could be positioned by fork lifts rather than through the use of cranes. Also, the individual ballast members could be readily cast in place, either in a circular continuous trough to form a solid ring of concrete or in separate ballast block forms.

The buoyant liquid chambers or wells of the instant invention are large, having a width of at least three to five or more feet, a height of from about eight to fifteen feet and a circumference of about 150 to 450 feet. The walls of such chambers are predominately of concrete. A concrete wall of 4" to 6" in thickness for various sizes of digesters may weigh from about 50,000 lbs to about 500,000 lbs.

The buoyant liquid chambers of the invention are large with respect to the tank. A launder trough or a seal trough merely for sealing purposes may be quite small in comparison. A launder trough is neither very deep nor very wide, while a sealing trough may be relatively deep for a telescoping gas-holding cover, but is generally quite narrow.

The utilization of a buoyant liquid chamber separate from the sludge holding portion of the tank provides numerous advantages. A particular advantage is that the sideskirt may be shorter since the rising and falling of the sludge level which required a deep skirt when the lower edge of the skirt is immersed in the sludge, is no longer a factor in sideskirt design. Shorter sideskirts save steel, which is desirable. Reducing the amount of steel in the sideskirt reduces the unballasted weight of the cover, thus necessitating more concrete ballast to achieve the higher operating gas pressures required in modern sludge digesters. Additional concrete ballast will generally result in ballast members which are wider, thereby necessitating very wide buoyant liquid chambers.

A further advantage of the separate buoyant liquid wells is the non-corrosive nature of the liquid, typically water, used in such wells. The problems of corrosion caused by immersion in sludge are avoided. Also, no sludge is exposed to the atmosphere and when the sideskirt is in an elevated position an unsightly sludge-stained external surface is not exposed. The well also acts as a seal against escape of gas. While a very narrow well could accomplish that purpose a wide well is required in the instant invention to accommodate the large ballast members used in modern gasholding sludge digesters.

Another advantage of a separate buoyant liquid chamber is that the density (specific gravity) of the liquid may be modified. For example, a liquid other than water could be used. Also, the specific gravity of water may be increased by adding of soluble salts. Such salts as barium chloride may be used to increase the specific gravity as high as 1.3.

In the event adding of salts creates a concern over corrosion, cathodic protection may be readily employed to protect metal parts immersed in the buoyant liquid. Such protection could not be as readily used to protect metal parts immersed in sludge.

The ballast bath digesters of the instant invention readily facilitate use of ballast members of the type disclosed in Cook et al., U.S. Pat. No. 4,391,705. However, conventional solid, concrete block ballasts may be employed as well as light weight concrete ballast blocks. Also, continuous ballast rings formed from concrete may also be utilized. Also, use may be made of various composite ballasts such as a concrete block combined with an air chamber.

The walls of the main digester tank as well as the ballast bath may be made of concrete or steel or some combination of the two.

The utilization of a separate buoyant chamber, generally denominated herein as a "ballast bath", to provide a buoyant liquid separate from the sludge liquid, to interact with the cover ballasts enables a sludge digester to be operated in a more flexible, less-polluting manner. The arrangement also makes certain monitoring and maintenance procedures easier and more effective.

Although the invention has been explained by reference to certain embodiments described herein it is to be understood that the invention is not to be limited thereto, but to have the scope set forth in the appended claims.

We claim:

1. A sludge digester gas-holder having a gas-holding cover structured to float on an envelope of gas having a variable volume and pressure comprising:

a. a main tank portion for holding sludge, said tank having a bottom and upwardly projecting sidewall, b. a cover having a top and depending sideskirt structured to telescope in close relation external to the upwardly projecting sidewall of said main tank, c. ballast support means attached near the lower, external edge of said sideskirt, d. ballast means supported on ballast support means near the lower, external edge of said sideskirt, e. a buoyant liquid chamber at least partially integral with and externally circumscribing said main tank sidewall near the upper portion of said main tank sidewall to form a chamber capable of holding a depth of liquid substantially equivalent to the height of said cover sideskirt and having a width greater than about three feet, said chamber structured to separate liquid in said chamber from sludge in the main tank.

2. The sludge digesters of claim 1 wherein the buoyant liquid chamber has a floor member attached to the main tank sidewall and structured to support the weight of the cover, depending sideskirt and ballast mambers and the weight of liquid in the buoyant liquid chamber.

3. The sludge digester of claim 1 wherein the buoyant liquid chamber has an upwardly projecting sidewall attached to its floor member and substantially concentric with and spaced a sufficient distance from said main tank sidewall to provide space for the cover sideskirt and ballast members, said chamber sidewall having a height substantially equal to or greater than the height of said coverskirt.

4. The sludge digester of claim 1 wherein the buoyant liquid chamber cavity is formed by the main tank wall and a second wall substantially concentric with said main tank wall and spaced therefrom a substantially uniform distance and supported by a cantilevered floor member connected to said main tank sidewall.

5. The sludge digester of claim 1 wherein the main tank sidewall is offset at the floor level of said buoyant liquid chamber to form the main tank sidewall in two sections, a lower section substantially centered with respect to said liquid chamber floor and an upper section which extends to a height substantially equivalent to that of the other wall of the buoyant liquid chamber.

6. The sludge digester of claim 1 wherein said cover sidewall has guide means attached thereto which stabilizes the cover during its telescoping travel within the buoyant liquid chamber.

7. The digester of claim 1 wherein said ballast means is a plurality of individual ballast members.

8. The digester of claim 7 wherein said ballast members are constructed of concrete.

9. The digester of claim 1 wherein said ballast means is constructed of concrete.

10. The digester of claim 1 wherein said main tank is constructed of concrete.

11. The digester of claim 10 wherein said buoyant liquid chamber is constructed of concrete.

* * * * *